US010693238B2

(12) United States Patent
Chi et al.

(10) Patent No.: US 10,693,238 B2
(45) Date of Patent: Jun. 23, 2020

(54) DUAL BAND ANTENNA WITH INTEGRATED CONDUCTIVE BEZEL

(71) Applicant: HEWLETT-PACKARD DEVELOPMENT COMPANY, L.P., Houston, TX (US)

(72) Inventors: David Chi, Taipei (TW); Po Chao Chen, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 267 days.

(21) Appl. No.: 15/748,180

(22) PCT Filed: Dec. 30, 2015

(86) PCT No.: PCT/US2015/067987

§ 371 (c)(1),
(2) Date: Jan. 27, 2018

(87) PCT Pub. No.: WO2017/116425

PCT Pub. Date: Jul. 6, 2017

(65) Prior Publication Data

US 2018/0219293 A1 Aug. 2, 2018

(51) Int. Cl.

| | |
|---|---|
| ***H01Q 1/24*** | (2006.01) |
| ***H01Q 9/28*** | (2006.01) |
| ***H01Q 5/378*** | (2015.01) |
| ***H01Q 1/22*** | (2006.01) |
| ***H01Q 1/38*** | (2006.01) |

(52) U.S. Cl.

CPC ..... *H01Q 9/285* (2013.01); *H01Q 1/2291* (2013.01); *H01Q 1/243* (2013.01); *H01Q 1/38* (2013.01); *H01Q 5/378* (2015.01)

(58) Field of Classification Search

CPC ..... H01Q 9/285; H01Q 1/2291; H01Q 5/378; H01Q 1/243; H01Q 1/24

See application file for complete search history.

(56) References Cited

U.S. PATENT DOCUMENTS

| | | | | |
|---|---|---|---|---|
| 7,053,837 | B2 | 5/2006 | Il et al. | |
| 7,450,072 | B2 | 11/2008 | Kim et al. | |
| 8,963,783 | B2 | 2/2015 | Vin et al. | |
| 2011/0156962 | A1 | 6/2011 | Jeong | |
| 2013/0234910 | A1 | 9/2013 | Oh et al. | |
| 2013/0257659 | A1* | 10/2013 | Darnell ..... | H01Q 1/243 343/702 |
| 2014/0159989 | A1 | 6/2014 | Malek et al. | |

(Continued)

OTHER PUBLICATIONS

Zhang, Z. et al, "Integrated Dual-band Antenna System Design Incorporating Cell Phone Bezel", Feb. 21, 2009.

*Primary Examiner* — Hoang V Nguyen
(74) *Attorney, Agent, or Firm* — HPI Patent Department

(57) ABSTRACT

Examples disclosed herein relate to a dual band antenna in a mobile device having a peripheral conductive member. In one example, the dual band antenna includes a multilayer PCB having a first antenna feed trace, a second antenna feed trace, a ground trace, and a connecting trace disposed on a dielectric substrate. The connecting trace may couple the first antenna feed trace, the second antenna feed trace, and the ground trace. Further, the dual band antenna includes a connecting element to couple to the connecting trace with the peripheral conductive member to form an integrated resonant element.

15 Claims, 6 Drawing Sheets

(56) References Cited

U.S. PATENT DOCUMENTS

| | | | |
|---|---|---|---|
| 2014/0184453 | A1 | 7/2014 | Chen et al. |
| 2015/0109171 | A1 | 4/2015 | Lin |
| 2015/0171916 | A1 | 6/2015 | Asrani et al. |

* cited by examiner

500A

DUAL BAND ANTENNA WITH INTEGRATED CONDUCTIVE BEZEL

BACKGROUND

Mobile devices are becoming increasingly popular. Examples of mobile devices include, handheld computers, such as notebooks and tablets, cellular telephones, media players and hybrid devices that include the functionality of multiple devices of this type.

Due in parts to their mobile nature, mobile devices may be often provided with wireless communications capabilities. Mobile devices may use wireless communications to communicate with wireless base stations. Multiple antennas may often be used for multiple applications, multiple frequencies, diversity schemes and the like.

BRIEF DESCRIPTION OF THE DRAWINGS

Examples are described in the following detailed description and in reference to the drawings, in which.

DETAILED DESCRIPTION

Mobile devices, such as notebook and laptop computers, cellular phones, personal digital assistants (PDAs), and so on may be commonly used in wireless operations. For example, mobile devices may communicate using Wi-Fi radio bands at 2.4 GHz and 5 GHz.

To satisfy consumer demand for small form factor, manufacturers continually strive to reduce the size of components used in the mobile devices. For example, manufacturers make attempts to miniaturize the antennas used in the mobile devices.

An antenna may be fabricated by patterning a metal layer on a circuit board substrate to fit within the tight confines of a mobile device. This may result in a design that compromises to accommodate the antennas in the mobile devices. Moreover, constraints are often bound on the amount of metal that can be used in a mobile device and the location of the metal parts. These constraints can adversely affect device operation.

The present specification provides various examples for improving antenna performance in a mobile device environment. In an example, the proposed solution uses metal bezel, in addition to using the patterned metal layers/feed traces, for dual band Wi-Fi antenna to enhance antenna performance. In one example, the proposed solution integrates patterned metal layers/feed traces of dual band Wi-Fi antenna with the conductive bezel used in a mobile device to enhance antenna radiation.

In the following description, for purposes of explanation, numerous specific details are set forth in order to provide a thorough understanding of the present techniques. It will be apparent, however, to one skilled in the art that the present apparatus, devices and systems may be practiced without these specific details. Reference in the specification to "an example" or similar language means that a particular feature, structure, or characteristic described is included in at least that one example, but not necessarily in other examples.

Figure 1:
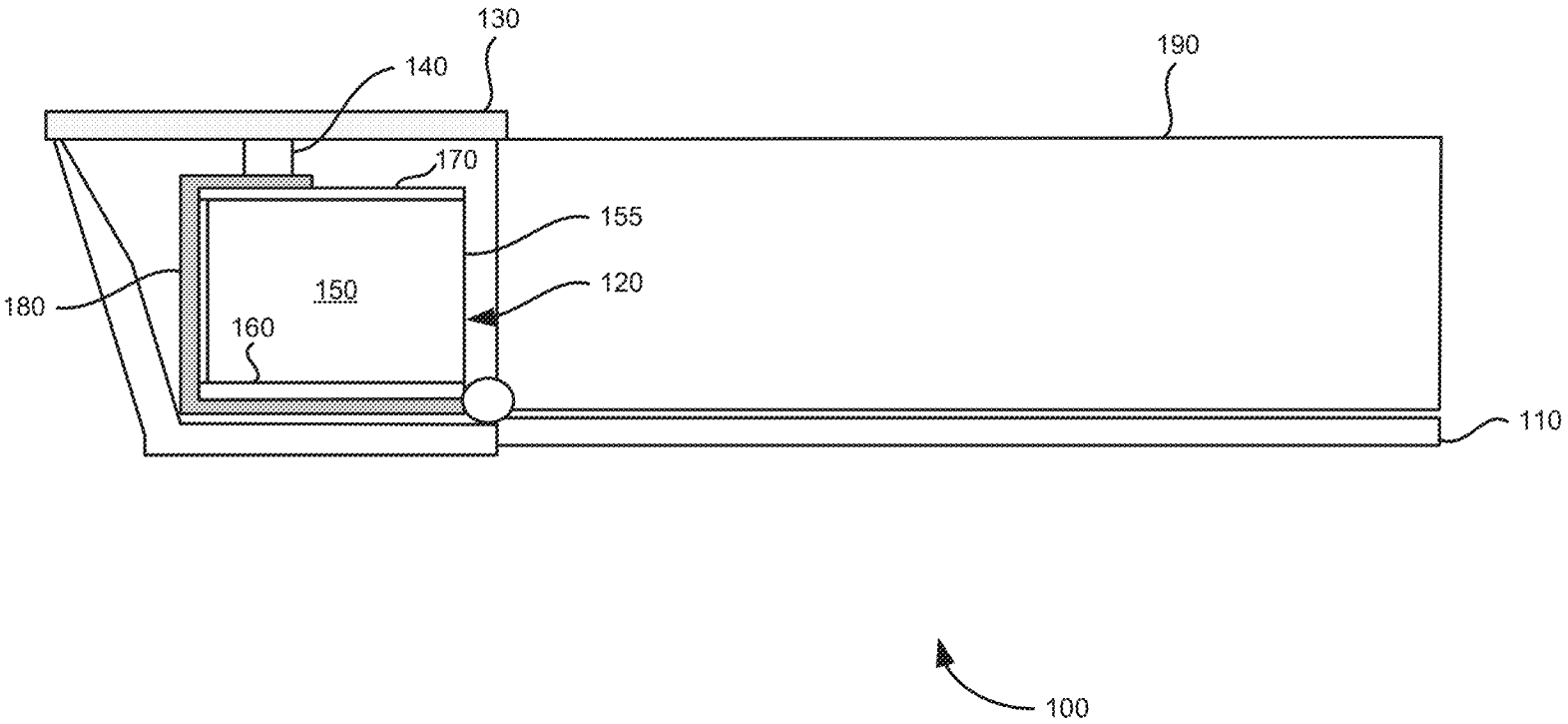
FIG. 1 illustrates an example sectional view of a structure of a dual band antenna disposed in a mobile device.

Turning now to the figures, FIG. 1 illustrates an example sectional view of a structure of a dual band antenna 120 disposed in a mobile device 100. As shown in FIG. 1, mobile device 100 may include a housing 110, a dual band antenna 120, a peripheral conductive member 130, and a connecting element 140.

In an example, the mobile device 100 may be a tablet computer, a notebook computer, a laptop computer, a cellular telephone, or a personal digital assistant (PDA). Example peripheral conductive member 130 may include, without limitation, a conductive bezel or a metal bezel that surrounds the periphery of the housing 110 of the mobile device 100. Peripheral conductive member 130 may be an integral part of housing 110 or a separate component disposed to surround the periphery of the housing 110. In another example, the peripheral conductive member 130 may be an electrically conductive member that may be disposed around the periphery of the housing and above a display device.

In an example, dual band antenna 120 may be a dipole dual band Wi-Fi antenna. In an instance, first antenna operates at a Wi-Fi radio band of about 2.4 GHz Wi-Fi and the second antenna operates at about radio band of about 5 GHz Wi-Fi.

In an example, connecting element 140 may be a spring, such as a metal spring. In one example, connecting element 140 is disposed between the peripheral conductive member 130 and a connecting trace 180 such that connecting element 140 along with peripheral conductive member 130 forms an integral part of resonant element of dual band antenna 120 to further enhance dual band antenna radiation. In an example, the connecting trace 180 may be a copper strip.

Figure 2A:
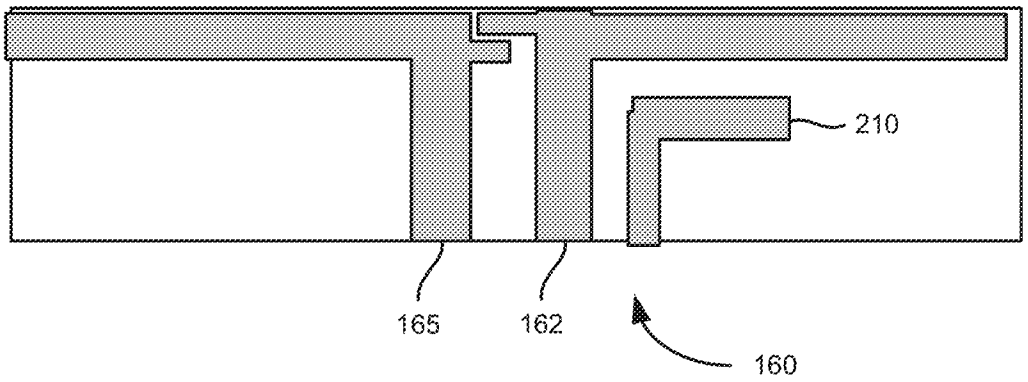
FIGS. 2A and 2B are example sectional views showing top and bottom conductive layers of multilayer printed circuit board (PCB) including both ground and feed traces of the dual band antenna, such as those shown in FIG. 1, according to one aspect of the present subject matter.
Figure 2B:
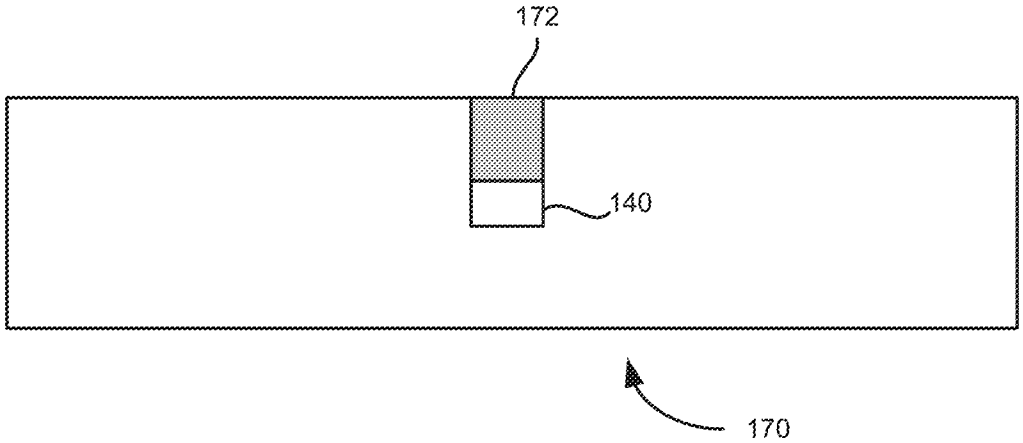

Also as shown in FIG. 1, dual band antenna 120 may further include a printed circuit board (PCB) 150. Example PCB 150 may be a single layer PCB, a double sided PCB, or a multilayer PCB. PCB 150 may include a first antenna feed trace 162 and a ground trace 165 on a bottom layer 160 (shown in FIG. 2A), a second antenna feed trace 172 formed on a top layer 170 (shown in FIG. 2B), and connecting trace 180. Further as shown in FIGS. 1, 2A and 2B, first antenna feed trace 162, ground trace 165, second antenna feed trace 172, and connecting trace 180 may all be fabricated on a dielectric substrate 155 that is disposed between the top layer 170 and the bottom layer 160. The term "dielectric substrate" and "dielectric member" may be used interchangeably throughout the document. Dielectric substrate 155 may be a non-conductive substrate made of FR-4 glass epoxy. Mobile device 100 may further include a display panel 190. In addition as shown in FIG. 2A, a parasitic strip/trace 210 may be included in the first layer 160 for 5 GHz frequency radiation.

Figure 3:
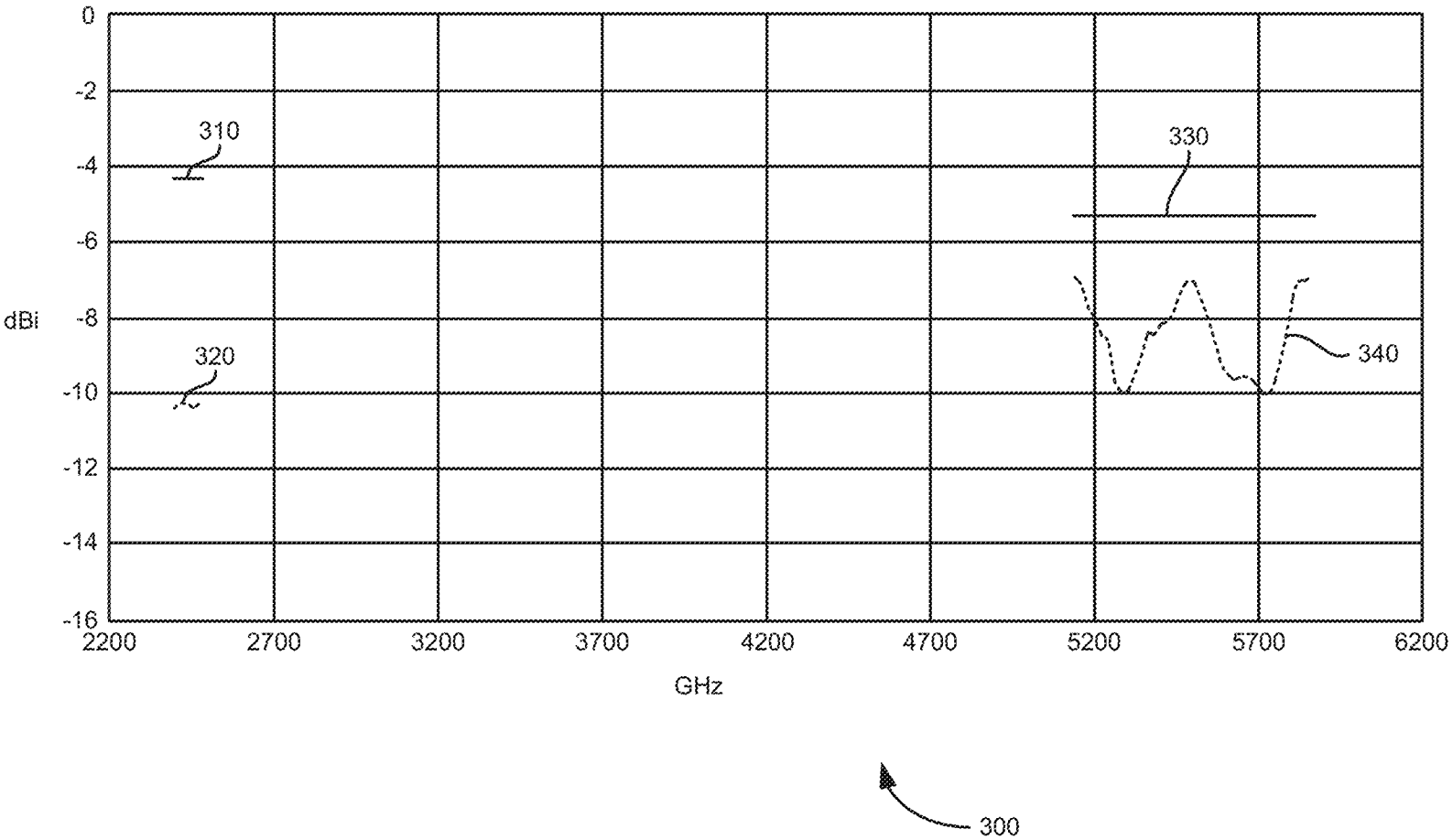
FIG. 3 depicts line graphs illustrating poor average gain in dBi obtained in simulation results when using Planar Inverted-F Antennas (PIFA) disposed in the dual band antenna over a frequency bandwidth range of about 2.4 GHz to 5.7 GHz, in the context of the present subject matter.

FIG. 3 depicts line graphs 300 of simulation results obtained using two Planar Inverted-F Antennas (PIFA) disposed in the dual band antenna over a frequency bandwidth of about 2.4 GHz to 5.7 GHz, in the context of the present subject matter. It can be seen from the line graphs 320 and 340 that there is a poor average gain from the standards 310 and 330 for the dual band antenna when operating at a range of about 2.4 GHz to 5 GHz.

Figure 4A:
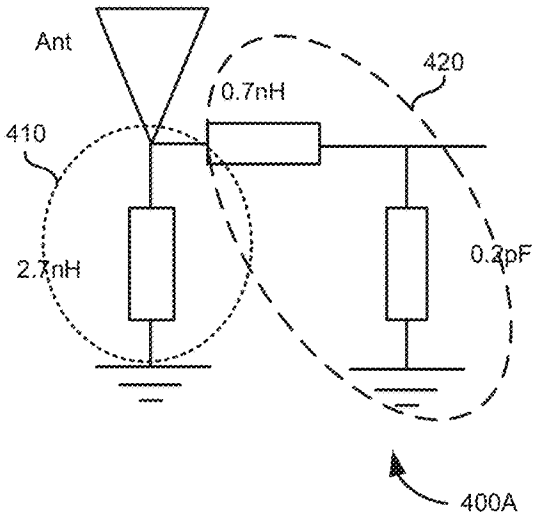
FIGS. 4A and 4B are example two component matching circuits used in dual band antenna, such as those shown in FIG. 1, to further enhance radiation performance, according to one aspect of the present subject matter.
Figure 4B:
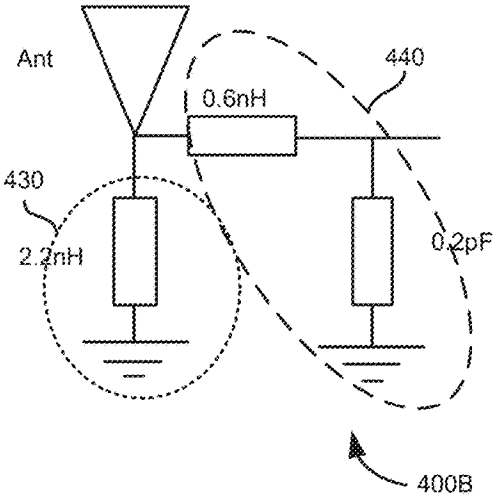

FIGS. 4A and 4B are example two component matching circuits 400A and 400B used in antenna assembly for 2.4 GHz and 5 GHz, such as those shown in FIG. 1, respectively, to enhance radiation performance. FIG. 4A includes a shunt capacitor and a shunt inductor for a low band 410 and a high band 420 to improve impedance matching of the L element and to improve the efficiency of the 2.4 GHz antenna. Similarly, FIG. 4B includes a shunt capacitor and a shunt inductor for a low band 430 and a high band 440 to improve impedance matching of the L element and to further improve the efficiency of the 5 GHz antenna.

Figure 5A:
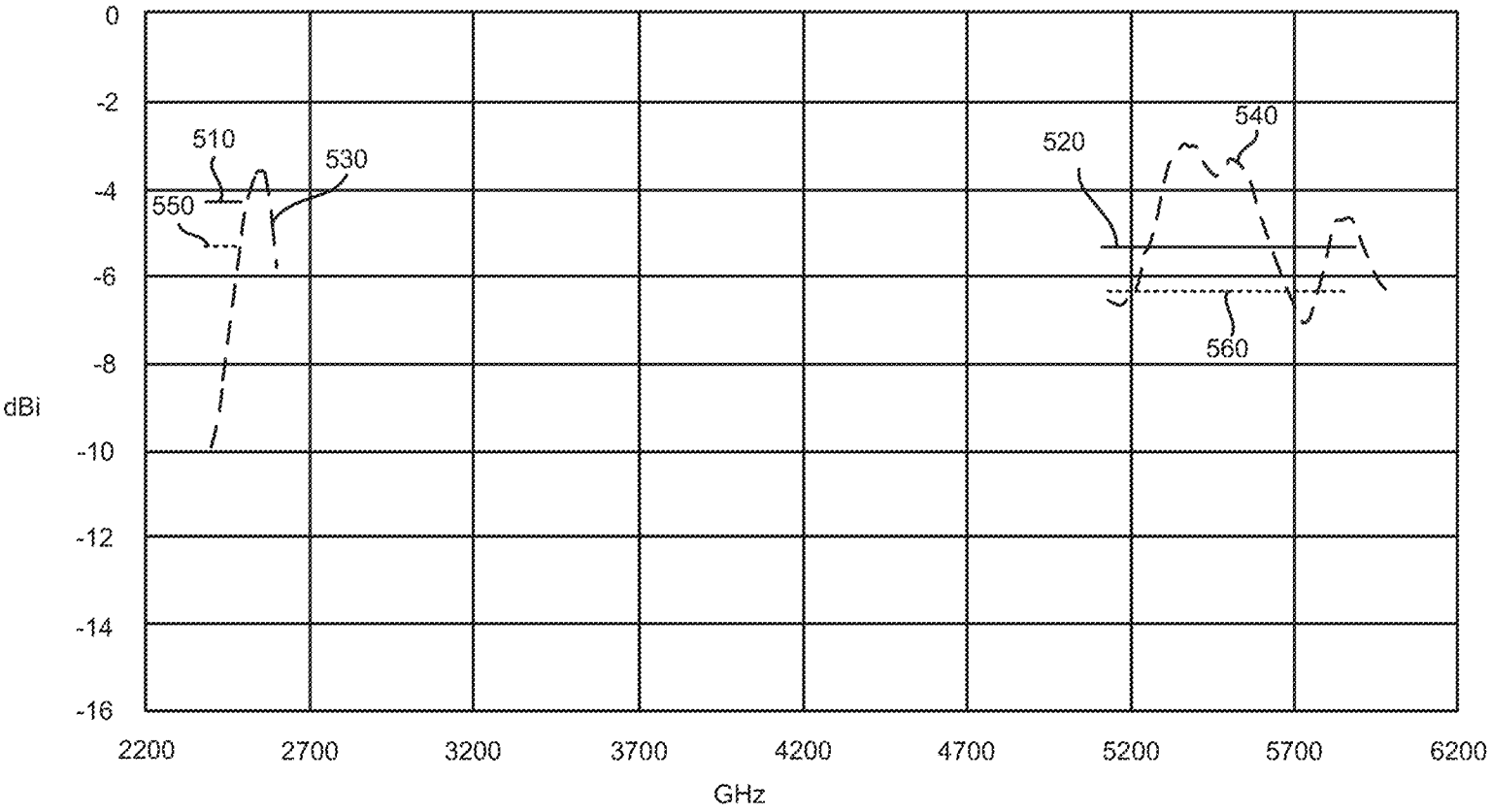
FIGS. 5A and 5B are example line graphs showing average gain in dBi realized over frequency ranges of about 2.4 GHz and 5 GHz when using the example matching circuits, such as those shown in FIGS. 4A and 4B, in the dual band antenna, respectively.
Figure 5B:
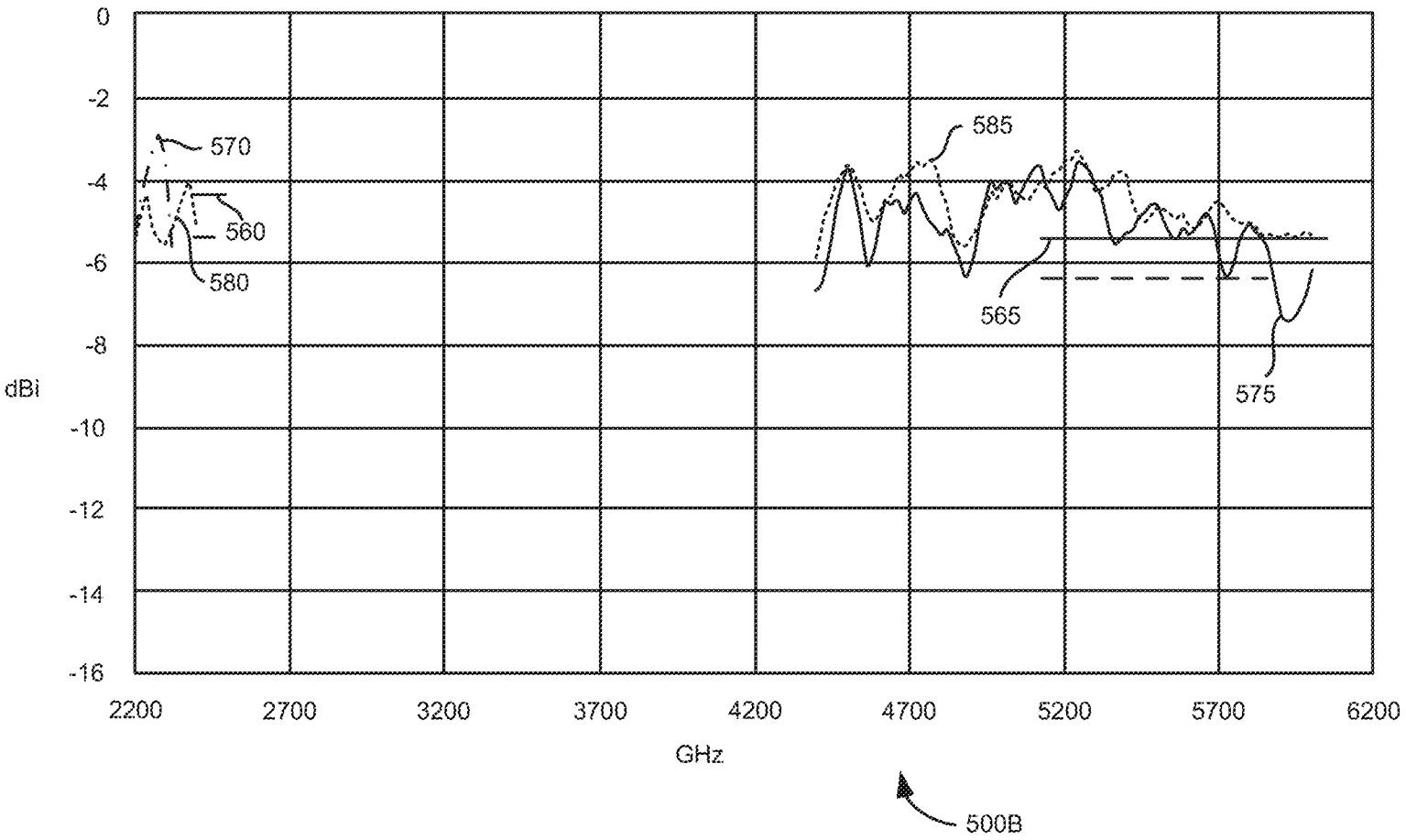

FIGS. 5A and 5B are example line graphs 500A and 500B showing average gain in dBi realized over frequency ranges of about 2.4 GHz and 5 GHz when using the example two component matching circuits 400A and 400B, such as those shown in FIGS. 4A and 4B, in the dual band antenna, respectively. As shown in FIG. 5A, line graphs 530, 540, 550 and 560 illustrate example average gain in dBi realized with reference to the standards 510 and 520, respectively when using the matching circuit 400A of FIG. 4A for 2.4 GHz and 5 GHz antennas. Similarly, as shown in FIG. 5B, line graphs 570, 575, 580, and 585 illustrate example average gain in dBi realized with reference to the standards 560 and 565 when using the matching circuit 400B of FIG. 4B for 2.4 GHz and 5 GHz antennas.

The example devices and systems described through FIGS. 1, 2, 4 and 5 may enhance antenna radiation performance. The example devices and systems described through FIGS. 1, 2, 4 and 5 may provide enhanced antenna radiation performance even when z-height is less than around 3 millimeters in a mobile device environment.

It may be noted that the above-described examples of the present solution are for the purpose of illustration only. Although the solution has been described in conjunction with a specific embodiment thereof, numerous modifications may be possible without materially departing from the teachings and advantages of the subject matter described herein. Other substitutions, modifications and changes may be made without departing from the spirit of the present solution. All of the features disclosed in this specification (including any accompanying claims, abstract and drawings), and/or all of the steps of any method or process so disclosed, may be combined in any combination, except combinations where at least some of such features and/or steps are mutually exclusive.

The terms "include," "have," and variations thereof, as used herein, have the same meaning as the term "comprise" or appropriate variation thereof. Furthermore, the term "based on," as used herein, means "based at least in part on." Thus, a feature that is described as based on some stimulus can be based on the stimulus or a combination of stimuli including the stimulus.

The present description has been shown and described with reference to the foregoing examples. It is understood, however, that other forms, details, and examples can be made without departing from the spirit and scope of the present subject matter that is defined in the following claims.

What is claimed is:

1. A dual band antenna in a mobile device having a peripheral conductive member, comprising:

a multilayer PCB having a first antenna feed trace, a second antenna feed trace, a ground trace; and a connecting trace disposed on a dielectric substrate, and wherein the connecting trace to couple the first antenna feed trace, the second antenna feed trace, and the ground trace; and a connecting element to couple to the connecting trace with the peripheral conductive member to form an integrated resonant element.

2. The dual band antenna of claim 1, wherein the connecting element is a metal spring that forms part of the dual band antenna, wherein the metal spring is disposed between the connecting trace and the peripheral conductive member to be integral with dual band antenna resonant element and to enhance dual band antenna radiation.

3. The dual band antenna of claim 1, wherein the dual band antenna is a dipole dual band Wi-Fi antenna.

4. A mobile device, comprising:

a housing having a peripheral conductive member;

a dual-band antenna disposed in the housing, wherein the dual-band antenna comprises a printed circuit board (PCB) having a first antenna feed trace, a second antenna feed trace, a ground trace, and a connecting trace disposed on a dielectric substrate, and wherein the connecting trace to connect the first antenna feed trace, the second antenna feed trace and the ground trace; and a connecting element disposed in the housing to connect the connecting trace with the peripheral conductive member to form an integrated dual band antenna with the peripheral conductive member.

5. The mobile device of claim 4, wherein the peripheral conductive member is a conductive bezel that surrounds the periphery of the housing of the mobile device.

6. The mobile device of claim 5, wherein the conductive bezel is a metal bezel that surrounds the periphery of the housing of the mobile device.

7. The mobile device of claim 4, wherein the connecting element is a metal spring that forms part of the dual band antenna, wherein the metal spring is disposed between the connecting trace and the peripheral conductive member to be integral with dual band antenna resonant element and to enhance dual band antenna radiation.

8. The mobile device of claim 4, wherein the dual band antenna is a dipole dual band Wi-Fi antenna.

9. The mobile device of claim 4, wherein the dual band antenna comprises a first antenna that communicates using Wi-Fi radio band at about 2.4 GHz and a second antenna that communicates using Wi-Fi radio band at about 5 GHz.

10. The mobile device of claim 4, wherein the mobile device is a tablet computer, a notebook computer, or a laptop computer.

11. The mobile device of claim 4, further comprising:

matching circuits to improve dual band antenna performance.

12. The mobile device of claim 4, wherein the PCB is a single layer PCB, a double sided PCB, or a multilayer PCB.

13. A tablet computer, comprising:

a housing;

an electrically conductive member disposed around a periphery of the housing and above a display device;

a dual band antenna disposed in the housing; wherein the dual band antenna comprises a multilayer PCB having a first antenna feed trace, a second antenna feed trace, and a ground trace disposed on a dielectric member; and a connecting element to couple the first antenna feed trace; the second antenna feed trace, and the ground trace with the electrically conductive member to form an integrated resonant element.

14. The tablet computer of claim 13, wherein the connecting element is a metal spring that forms part of the dual band antenna, wherein the metal spring is disposed between a connecting trace and the electrically conductive member to be integral with dual band antenna resonant element and to enhance dual band antenna radiation, wherein the connecting trace to electrically couple the first antenna feed trace, the second antenna feed trace, and the ground trace.

15. The tablet computer of claim 13, wherein the dual band antenna is a dipole dual band Wi-Fi antenna.

* * * * *